United States Patent [19]

Lipp

[11] Patent Number: 4,591,342

[45] Date of Patent: May 27, 1986

[54] VELOCITY-SIMULATOR FOR CONTROLLING THE RECIPROCAL MOVEMENTS OF PARTS OF A LARGE CALIBER GUN BARREL

[75] Inventor: Herbert Lipp, Duesseldorf, Fed. Rep. of Germany

[73] Assignee: Rheinmetall GmbH, Duesseldorf, Fed. Rep. of Germany

[21] Appl. No.: 678,793

[22] Filed: Dec. 6, 1984

[30] Foreign Application Priority Data

Dec. 17, 1983 [DE] Fed. Rep. of Germany ..... 3345768

[51] Int. Cl.[4] ..... F41F 27/00

[52] U.S. Cl. ..... 434/18

[58] Field of Search ..... 434/18

[56] References Cited

U.S. PATENT DOCUMENTS 4,194,304 3/1980 Wolcott ..... 434/18

*Primary Examiner*—William H. Grieb

[57] ABSTRACT

An improved velocity simulator which simulates the control movements of a large caliber gun barrel recoil and counter-recoil in a constricted chamber where there is provided a mechanism for controlling and checking the recoil and counter-recoil moving parts, in particular for controlling and checking the movements of the breech mechanism and the loading process. These movements generally have variable velocities and the control movements thereof can be interrupted randomly and without danger, which velocity simulator is adapted to be placed in operation whereby the gun barrel is adapted to be moved to its initial position by the velocity simulator against the force of a counter-recoil mechanism.

The velocity simulator consists of a modular construction which connects hydraulically the driven control part and piston cylinder unit to a hydraulic power supply source whereby the control movement of a recoil and counter-recoil mechanism have an adjustable velocity, as well as a rapid operable movement. The adjusted velocities of the simulator correspond to the maximum counter recoil velocity and randomly safe interruptions of the recoil and counter-recoil movements are possible. The velocity simulator has a relatively short constructional length which is smaller than twice the stroke length so that when in an index position of the gun barrel, it can be mounted manually in a constricted space, between the bottom member and the turret rim. The velocity simulator is coupled via attachable couplings to the fluid pressure source of the large caliber gun barrel.

9 Claims, 5 Drawing Figures

VELOCITY-SIMULATOR FOR CONTROLLING THE RECIPROCAL MOVEMENTS OF PARTS OF A LARGE CALIBER GUN BARREL

BACKGROUND OF THE INVENTION

It is known for purposes of testing the technical performance of large caliber gun barrels to, for example, control the breech movement and the loading movement of the weapon by pulling slowly backward those parts of the gun barrel which, at firing, recoil and counter-recoil. Such pulling backwards is done with the aid of chains or cables and is carried out slowly and then, by mechanically releasing the chains or cables by way of a ratchet mechanisms, a rapid counter-recoil velocity of the gun barrel which corresponds to that at firing is effected. In addition to the danger that occurs due to the sudden release of the chain or cable at ratchet release it is difficult to install the chain or cable pulling mechanism in a compact recoil chamber, in particular in such a chamber in an armored howitzer. Moreover, it is not possible with chain or cable pulling devices to effect a slow, respectively a rapidly variable recoil movement. Above all other considerations it must be recognized that for checking and adjusting the breech function and the loading mechanism, which is disposed at the rear end of the gun barrel, the recoil and counter-recoil movement of a large caliber gun barrel cannot be interrupted, in particular not at maximum counter-recoil velocity when a so-called "cold firing" occurs.

SUMMARY OF THE INVENTION

In view of the foregoing it is an object of this invention to provide a velocity simulator which constitutes an improvement over the velocity simulators of the state of the art in that the control movements of the gun barrel recoil and counter-recoil movements can have adjustable velocities and a random safe interruption of the control movements can be effected, above all also during the maximum counter-recoil velocity. Furthermore, the velocity simulator of this invention is manually portable and can be installed in a compact recoil chamber preferably in the turret of an armored howitzer.

The invention distinguishes itself advantageously in that by means of a modular type of construction it can be installed as a mobile ready to be used assembly in the field, thereby providing a safe and compact unit that can be serviced in the field. This modular type of construction includes control and piston units which are hydraulically connected to each other and are manually portable. This modular type of construction is capable of being installed in a compact recoil chamber which, by means of rapidly joinable coupling units, can be connected to a simple pressure supply, for example in the turret of an armored howitzer, in which the firmly installed hydraulic pressure supply can be rapidly coupled to the device.

It has been determined that two throttle nozzles can be advantageously integrated into the control and piston unit thereby variably adjusting the recoil and counter-recoil velocities of the gun barrel. By means of a switching valve of the control and piston unit the retractable gun barrel can, during the counter-recoil or recoil movement, be held in any random position, whereby it is further advantageously possible to check movements at the gun barrel and at a loading arrangement disposed behind the gun barrel and to adjust such arrangement. By means of the arrangement of a 2/2 flow control valve which is built into a differential piston in the form of a piston rod streaming of the hydraulic medium during the recoil and the slow counter-recoil causes movement of the piston rod out of the cylindrical chamber into the position which is substantially resistance-free and into the cylindrical chamber of the differential piston by the the streaming of the hydraulic medium during the rapid counter-recoil. In view of the fact that the differential piston is arranged at the end of the piston rod within the hydraulic cylinder, there are required, in accordance with the piston rod cross-section times the length of the counter-recoil movement, relatively minor quantities of remaining fluid as well as relatively minor feed flow cross-sections for the cylinder chamber of the differential piston. The unilateral arrangement of the piston rod furthermore permits a further constructional feature for the control and piston cylinder units, which is a short constructional length which is two times smaller than the piston stroke, whereby the installation of compactly measured recoil chambers corresponding in constructional length to the corresponding minimum distance is made possible, for example between a bottom member of a recoiling gun barrel and a turret rim.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
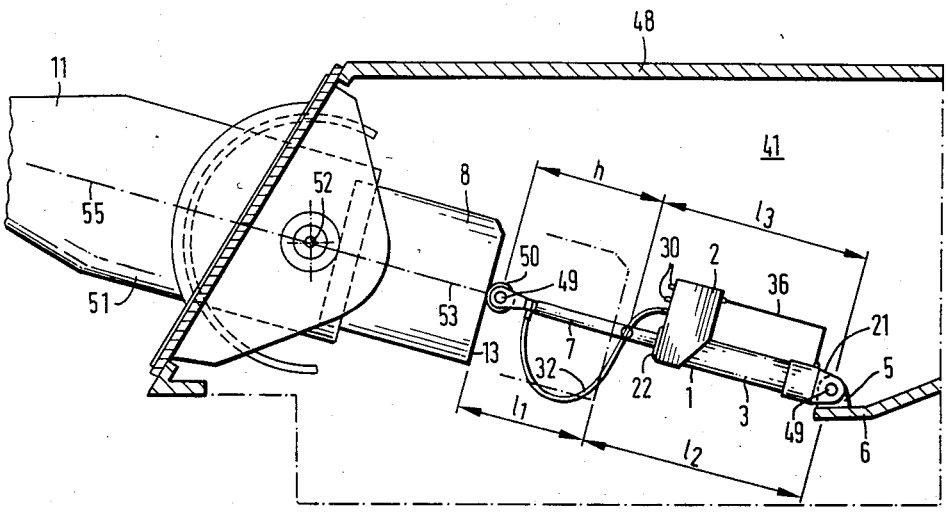
FIG. 1 is a schematic partially cross-sectional view of a portion of an armored turret of a large-caliber gun barrel and the arrangement of a velocity simulator connected to the bottom member of a recoiling and counter-recoiling gun barrel and a turret rim.
Figure 2:
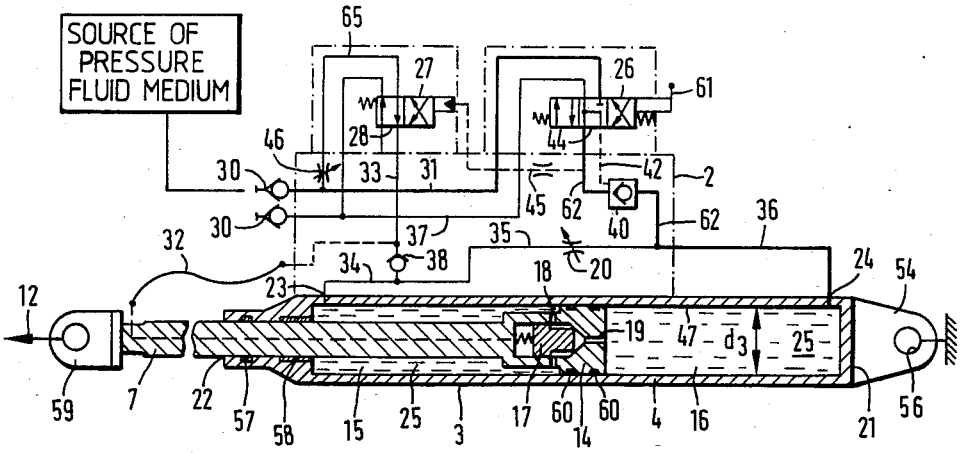
FIG. 2 is a schematic illustration of control and piston cylinder units of the velocity simulator in the "stop" switching position.

In FIGS. 2 to 5 the control elements are illustrated in accordance with ISO (INTERNATIONAL ORGANISATION FOR STANDARDIZATION) 1219. In FIG. 1 there is clearly illustrated the arrangement of a velocity simulator 1 mounted within a turret 48 which is rotatable in the azimuth plane of a large-caliber armored howitzer between a part 8 which recoils and counter-recoils with the gun barrel 11 preferably the bottom member 13 and a support 5 which is fixed to the weapon, preferably on the weapon rim 6. The velocity simulator 1 consists of a control unit 2 and a cylinder unit 3 which are joined to each other by means of a modular type of constructional connection. A unilaterally extending piston rod 7 is reciprocally mounted in the cylinder unit 3 and extends from the end 22 of the cylinder 4 (FIG. 2). The piston rod 7 is connected via a first bolt 49, which is manually detachable, to the support 50 which is arranged at the rearward end of the bottom member 13, whereas the cylinder 4 is also connected via a second bolt 49, which is manually detachable, at the opposite end 21 thereof (FIG. 2) with the support 5 of the turret rim 6.

The control unit 2 and cylinder unit 3 are connected to a source of hydraulic fluid in a simple manner by means of two directly rapidly attachable couplings 30. These feed couplings are firmly connected within the turret 48. They are constructed in such a way that a counter-recoil mechanism (not illustrated), acts counter to the force acting in the direction 12 arranged in the gun barrel cradle 51 (FIG. 2). This non-illustrated counter-recoil mechanism assumes an index position 53 about the trunnion axis 52 about which the gun barrel 11 is pivoted in accordance with various positions illustrated in FIGS. 2 to 5, wherein there is schematically illustrated switching positions for the functional control of the recoiling and counter-recoiling part 8. A non-illustrated loading arrangement is retractable with different recoil velocity and is slowly variable or, with the maximum counter-recoil velocity which occurs at firing, is forwardly movable. The courses of motions in any random position within the recoil weapon length $l_1$ can be interrupted without endangering the installation. The velocity simulator 1 has such a short built-in length $l_3$ when the piston rod 7 has been retracted over a stroke length h that it can be installed in compactly dimensioned recoil chambers 41 with a recoiling gun barrel 11 recoiling about a recoil length $l_1$ between the bottom member 13 and the turret rim 6 there remaining a rest distance $l_2$ which is smaller than two recoil lengths $l_1$ respectively two piston stroke lengths h in the index position 53, whereby the bottom member 13 extends beyond the gun barrel end along the gun barrel axis 55. By means of mounting the velocity simulator 1 on the extended gun barrel axis 55 the operation of the weapon is not hindered, in particular the not further illustrated breech mechanism and the also not further illustrated loading arrangement, so that a loading process can be effected as a result of the gun barrel counter-recoil movement.

The construction and manner of operation of the projectile simulator 1 in conjunction with FIGS. 2 to 5 will be now explained in detail.

According to FIG. 2 the piston cylinder unit 3 consists of a cylinder 4, known per se, having a constant inner diameter $d_3$ and having a smooth internal bore 47. The end 21 of the cylinder 4 has a strap for fastening to the support 5 which is arranged at the turret rim 6 (FIG. 1) which strap contains a bore 56. The other end 22 of the cylinder 4 includes, for purposes of guiding and sealing the piston rod 7 in the cylinder 4, a sealing ring 57 and a guide bushing 58. At the outer end of the piston rod 7 there is provided a fork member 59 for connecting it by means of bolt 49 to the support 50 of the bottom member 13 (FIG. 1).

The portion of the piston rod 7 which is disposed within the cylinder 4 is constructed as a differential piston 14 which is slidable within the cylinder unit 4 and has friction-less sealing and guiding rings 60 disposed at the walls of the bore 47. The differential piston 14 includes a hydraulic releasable 2/2 stream path control valve 17 with two connecting conduits and two predetermined switching positions. In FIG. 2 the switching valve 17 is illustrated in a closed position so that the cylindrical chamber 15 which surrounds the piston rod 7 is not connected with the cylindrical chamber 16 via the inlet 18 and outlet 19 of the differential piston 14, which cylindrical chamber 16 is unilaterally defined by the differential piston 14. The cylindrical chamber 15 has at the end 22 a conduit 23 and the cylindrical chamber 16 has at the end 22 a conduit 24 for a control unit 2. Within this control unit 2 the conduits 23, 24 can indirectly, via the hydraulic conduits 34, 35, 36 and via a throttling valve 20, disposed between the conduits 35, 36, be placed in fluid communication with each other. The throttling valve 20 is, however, also closed so that in the arrangement in accordance with FIG. 2 there is also not present an outer connection between the cylindrical chambers 15, 16.

For adjusting the control function "stop" (FIG. 2), slow "counter-recoiling" (FIG. 3) and "rapid counter-recoil" (FIG. 4) there is provided within the control unit 2 a known 4/3 stream switching and flow path defining valve mechanisms designated as a switching valve 26, whose switch 61 is manually actuable from outside of the control unit 2. Additionally, the control unit 2 includes a further 4/2 stream switching and path flow determining valve 27, which can only in the switching position "rapid counter-recoil" (FIG. 4) of the switching valve 26 assume a second switching position 29 via the action of a communicating conduit 45 relative to a first basic switching position 28 in an automatic pressure dependent manner. Both valves 26, 27 are respectively joined to pressure conduits 31 and discharge conduit 37, which lead outside of the control unit 2 where they can be coupled to other non-illustrated conduits via the rapid attachable coupling 30 and the corresponding pressure medium supply net of the gun barrel.

Switching valve 26 is joined via the conduit 62, 36 and 24 to the cylindrical chamber 16. In the conduit string of the conduit 62 there is disposed an openable check valve 40 which is connected to the switching valve 26 via a precontrol conduit 42.

The switching valve 27 establishes, when in the basic position 28, via the conduit 32 and a check valve 38, opened in the streaming-in direction 64 (FIG. 3), a communication for the conduits 34 and 35. Between the switching valve 27 and the check valve 38 there is joined at the conduit 33 the control conduit 32 of the openable switching valve 17. This switching valve 17 is operatively mounted in the forward end of the piston rod 7 and the conduit 32 is in communication with the valve chamber of the switching valve 17 within the piston rod. A further adjustable throttle valve 46 is disposed in the communication conduit 65 mounted between the pressure conduit 31 and the 4/2 switching and flow path determining valve 27.

Figure 3:
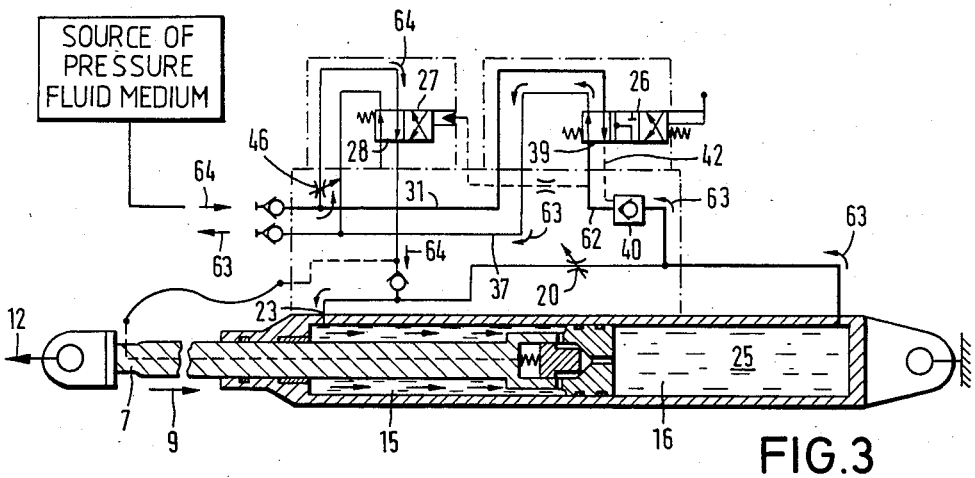
FIG. 3 is a schematic illustration of the control and piston cylinder units in the switching position "slow recoil"

In the switching position 44 "stop" of the switching valve 26 the communicating connection of the pressure conduit 31 with the cylindrical chamber 16 is interrupted via the closing of a check valve 40, whereby also when check valve 38 is closed and flow path control valve 17 is hydraulically adjusted as well as throttling valve 20 is manually closed the piston rod 7 is not movable in the direction 12 by the pulling force of the gun barrel counter-recoil in the direction 10 (FIG. 4) or by means of the differential piston 14 in the direction 9 (FIG. 3).

In the switching position 39 "slow recoil" of the switching valve 26 (FIG. 3) the pressure conduit 31 is in communication with the pre-adjustment conduit 42 of the check valve 40, whereby the check valve 40 is unlocked. The hydraulic medium 25, at closed throttling valve 20 is adapted to be expelled from the cylindrical chamber 16 in the outflowing direction 63 via the conduit 62 into the outlet conduit 37. The pressure conduit 31 is thereby placed in direct communication with the cylindrical chamber 15 in the basic switching position 28 of the flow stream control valve 27, in which the hydraulic medium 25 streams inwardly in the streaming-in direction 64, whereby the piston rod 7 is adapted to be pulled back in the direction 9 counter to the force acting in the direction 12 of the counter-recoil and by means of the adjustable throttle valve 46 with a different counter-recoil velocity.

Figure 4:
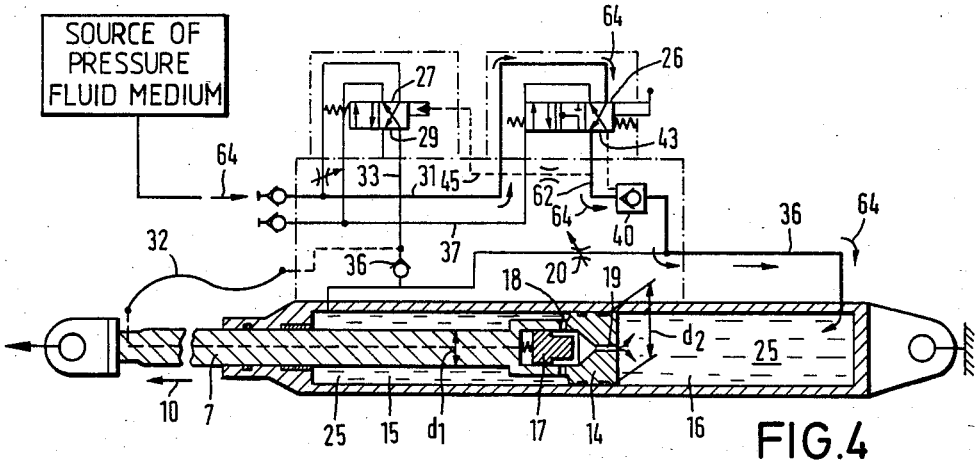
FIG. 4 is a schematic illustration of the control and piston cylinder units in the switching position "rapid counter-recoil"

In the switching position 43 "rapid counter-recoil" of the switching valve 26, in accordance with FIG. 4, the pressure conduit 31 is placed in communication via the automatically opened check valve 40 with the cylindrical chamber 16. Thereby the flow path control valve 27 is in the condition, to assume the second switching position 29 via the pressure controlling action of the conduit 45. In this switching position 29 there is, however, interrupted the communicative connection of the pressure conduit 31 to the conduit 33 and the conduit 33 is communicatively connected to the outlet conduit 37, so that the control conduit 32 is pressure-unloaded and the flow path control valve 17, at closed check valve 38 and closed throttle valve 20, is opened by the pressure building up by way of the force of the counter-recoiler in the cylindrical chamber 15 and the hydraulic medium 25 can stream directly and rapidly and without a hydraulic resistance that is worth mentioning at the forward end face of the differential piston 14 through the openings 18, 19 and through the relatively large widths of the flow control valve 17 from the cylindrical chamber 15 into the cylindrical chamber 16 thereby moving it in the direction 10. As a result of the different diameters $d_1$ of the piston rod 7 and $d_2$ of the differential piston 14 there flows, in addition to the fluid quantity flowing inwardly from the cylindrical chamber 15, the rest of fluid quantity required for the rapid counter-recoil in the streaming-in direction 64 through the conduits 31, 62 and 36 into the cylindrical chamber 16.

Figure 5:
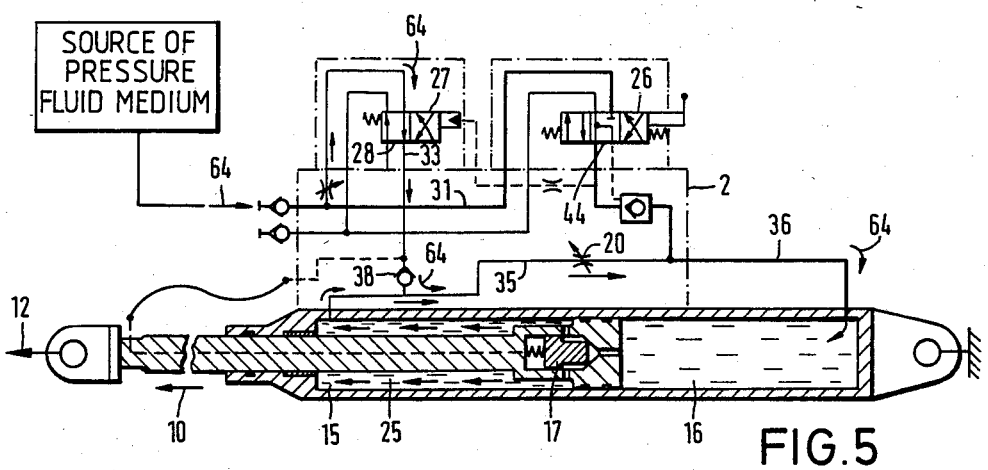
FIG. 5 is a schematic illustration of the control and piston cylinder units in the switching position "slow counter-recoil".

According to FIG. 5 the piston rod of the velocity simulator 1 can be loaded by variable slow counter-recoil velocities acting in the force direction 12 by the counter-recoiler and thereby the counter-recoiling parts 8 moving in the direction 10 (FIG. 1) are adjustable.

In the switching position 44 "stop" on the switching valve 26 and in the basic switching position 28 of the control valve 27 as well as at closed flow control valve 17 there can flow into the cylindrical chamber 16 at differently opened throttle valve 20 the hydraulic medium 25 from the cylindrical chamber 15 and the hydraulic medium 25 via the conduits 31, 33, 35 and 36 in the direction 64 corresponding to the desired counter-recoil velocity being differently throttled.

In addition to the constricted counter-recoil chamber 41 (FIG. 1) of an armored howitzer which has been described and in which it can advantageously be operatively installed the velocity simulator 1 (FIG. 1) can, with little energy input and with a high hydraulic transferable recoil force of, for example 80 kN above all by means of reduced, preferably in nominal dimension of 6 mm connecting conduits and valves still be constructed to be manually portable so that the velocity simulator 1 can also be operatively installed with non-illustrated large caliber gun barrels having a caliber diameter equal to or larger than 90 mm and relatively high counter-recoil forces, for example, be placed in operation in the field.

Although an embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved velocity simulator for controlling the movement of the recoil and counter-recoiling parts during the firing of a large caliber gun barrel with a piston cylinder unit filled with hydraulic medium by way of controllable valves, whose projecting piston rod of a differential piston on one side of the cylinder pulls backwards the recoil and counter-recoiling parts against the force of a barrel counter-recoil mechanism, the improvement comprising (a) a control unit formed by three control valves which is joined in unit construction with a piston cylinder unit and which contains an additional valvel whereby the said control unit allows for the controlled movement of a variable velocity recoil and counter-recoil as well as the rapid counter-recoil corresponding to the maximum counter-recoil velocity and guarantees an arbitrary secured interruption, (b) a control unit of the velocity simulator joined in unit construction with a unit piston cylinder unit which can be manually installed in a short period of time in a narrowly dimensioned installation space next to a gun barrel moving backward by a barrel recoil distance with an axial length remaining between the bottom member and a turret rim barrel recoil lengths on a gun barrel axis extended over and beyond a bottom member.

2. Velocity simulator according to claim 1, the improvement comprising (a) within the said cylinder the movement of the first portion of the cylinder surrounding the piston rod over the first inlet-outlet and the movement of the second portion of the cylinder delimited by the differential piston over the second inlet-outlet requires separate fillings of the control unit with hydraulic medium, (b) the said additional valve of the differential piston is a flow path control valve, whereby the hydraulic medium can flow directly out of the first portion of the cylinder into the second portion of the cylinder for simulation of the rapid uninhibited counter-recoil.

3. The improvement in a velocity simulator for controlling the movements of the recoiling and counter-recoiling parts of a large-caliber gun barrel as set forth in claim 2, wherein said control unit includes a 4/3 flow path control valve which functions as a selectively actuable first switching valve means which is adapted to be selectively and adjustably switched to a preselected one of the following switching positions: "slow recoil", "rapid counter-recoil" and "stop".

4. The improvement in a velocity simulator for controlling the movements of the recoiling and counter-recoiling parts of a large-caliber gun barrel as set forth in claim 3, wherein said control unit includes a first adjustable throttle valve which is operatively adjustable fluid-communicatively connected to said first and second inlet-outlet in said cylinder in such a way that said pressure fluid medium flows with different preselected velocity from said first portion to said second portion of said cylinder and only said counter-recoil movement of the piston rod in the direction toward the gun barrel is adjustable.

5. The improvement in a velocity simulator for controlling the movements of the recoiling and counter-recoiling parts of a large-caliber gun barrel as set forth in claim 4, including the following additional features:

(a) said control unit having a 4/2 flow path control valve which functions as a second switching valve means, a first conduit operatively fluid-communicatively connecting said first and second switching means, whereby when said first switching valve means is in the "rapid counter-recoil" switching position said second switching valve means is switched via the pressure fluid medium flow through said first conduit from a basic first switching position to a second switching position; including a pressure fluid power supply source, a second conduit in direct fluid communication with said first inlet-outlet for the slow recoil movement of the piston rod or in fluid communication with said second inlet-outlet for the slow counter-recoil movement of the piston rod when said first throttling valve is open, and (b) when said second switching valve means is in said basic first switching position by rapidly fluid-communicatively coupling said pressure fluid power supply source to a second conduit so that for the slow recoil movement of the piston rod a direct fluid communication is established via a third conduit and via said third conduit to said first inlet outlet or at slow counter-recoil the piston rod at open throttle valve via said third conduit to said second inlet-outlet, whereby for blocking said flow path control valve there is disposed between said second switching valve means and said first inlet-outlet and there is fluid-communicatively connected a control conduit to said third conduit;

(c) whereby said first conduit is blocked when said second switching valve means is in said second switching position, said control conduit is pressure unloaded and is fluid-communicatively connected to an outlet conduit, whereby the third conduit includes a first check valve which blocks one first portion of the third conduit from an other second portion of the third conduit.

6. The improvement in a velocity simulator for controlling the movements of the recoiling and counter-recoiling parts of a large-caliber gun barrel as set forth in claim 5, whereby when said first switching valve means is in the switching position "slow recoil" said second conduit is fluid-communicatively connected with a preadjustment conduit of an unlockable first check valve disposed between the first switching valve means and the second portion of the cylinder, and said first check valve is opened, whereby for the outstreaming of the pressure fluid medium from the second portion of the cylinder, it is fluid-communicatively connected via the first switching valve means with the outlet conduit.

7. The improvement in a velocity simulator for controlling the movements of the recoiling and counter-recoiling parts of a large-caliber gun barrel as set forth in claim 6, wherein when said first switching valve means is in the switching position "rapid counter-recoil" said first switching valve means fluid-communicatively connects the second conduit via the automatically opened first check valve 40 with the second portion of the cylinder and thereby as a result of the difference in diameter d 1 of the piston rod and d 2 of the differential piston an additional required quantity of pressure fluid medium required for a rapid counter-recoil streams from the first portion of the cylinder into the second portion of the cylinder.

8. The improvement in a velocity simulator for controlling the movements of the recoiling and counter-recoiling parts of a large-caliber gun barrel as set forth in claim 7, whereby when said first switching valve means is in the "stop" switching position the fluid communication of the second conduit with the second portion of the cylinder is interrupted and said second check valve is closed, and at closed flow path control valve and first adjustable throttle valve, said piston rod is not movable in the direction away from the gun barrel.

9. The improvement in a velocity simulator for controlling the movements of the recoiling and counter-recoiling parts of a large-caliber gun barrel as set forth in claim 8, including a second adjustable throttle valve fluid-communicatively connecting said second conduit to said second switching valve means, whereby the recoil velocity of the piston rod in the direction away from the gun barrel is adjustable.

* * * * *